US012297739B2

(12) United States Patent
Stoessel

(10) Patent No.: US 12,297,739 B2
(45) Date of Patent: May 13, 2025

(54) ROTARY VANE PUMP

(71) Applicant: Valeo Powertrain GmbH, Ebern (DE)

(72) Inventor: Roland Stoessel, Ebern (DE)

(73) Assignee: Valeo Powertrain GmbH, Ebern (DE)

( * ) Notice: Subject to any disclaimer, the term of this patent is extended or adjusted under 35 U.S.C. 154(b) by 0 days.

(21) Appl. No.: 18/311,263

(22) Filed: May 3, 2023

(65) Prior Publication Data

US 2023/0358228 A1 Nov. 9, 2023

(30) Foreign Application Priority Data

May 6, 2022 (DE) ..... 10 2022 111 278.0

(51) Int. Cl.

| | |
|---|---|
| ***F01C 21/10*** | (2006.01) |
| ***F01C 21/08*** | (2006.01) |
| ***F04C 2/344*** | (2006.01) |
| ***F04C 14/22*** | (2006.01) |
| ***F04C 18/344*** | (2006.01) |

(52) U.S. Cl.

CPC ..... *F01C 21/106* (2013.01); *F01C 21/0836* (2013.01); *F04C 2/3442* (2013.01); *F04C 14/226* (2013.01); *F04C 18/3441* (2013.01); *F04C 2240/20* (2013.01)

(58) Field of Classification Search

CPC .. F04C 2/3442; F04C 2/3446; F04C 2240/20; F04C 14/226; F04C 18/3441; F01C 21/0863; F01C 21/0836; F01C 21/108; F01C 21/106

USPC ..... 418/260, 268, 145

See application file for complete search history.

(56) References Cited

U.S. PATENT DOCUMENTS 894,391 A * 7/1908 Pittler ..... F01C 1/3448 418/219
990,163 A * 4/1911 Pittler ..... F04C 18/348 418/173
1,058,496 A * 4/1913 Thompson ..... F01C 19/04 418/137

(Continued)

FOREIGN PATENT DOCUMENTS

DE 10 2007 039 172 A1 12/2008
DE 10 2011 011 690 A1 8/2012

(Continued)

OTHER PUBLICATIONS

JP-2005120893-A, English Language Machine Translation (Year: 2005).*

(Continued)

*Primary Examiner* — Wesley G Harris

(74) *Attorney, Agent, or Firm* — Oblon, McClelland, Maier & Neustadt, L.L.P.

(57) ABSTRACT

A rotary vane pump includes a pump housing, a stator, a rotor, a plurality of vanes which are accommodated in the rotor so as to be displaceable in the radial direction, so that they delimit a plurality of pump chambers between themselves, the stator and the rotor. A radially inner cam surface is provided, against which the vanes rest, wherein secondary chambers are delimited in the radial direction between the cam surface and the rotor and in the circumferential direction between the vanes, with a suction inlet and a pressure outlet being assigned to the secondary chambers.

7 Claims, 6 Drawing Sheets

(56) References Cited

U.S. PATENT DOCUMENTS

| | | | | | |
|---|---|---|---|---|---|
| 2,099,193 | A * | 11/1937 | Curtis | F04C 2/34 418/177 |
| 2,280,272 | A * | 4/1942 | Sullivan | B01F 25/60 417/252 |
| 3,904,327 | A * | 9/1975 | Edwards | F01C 1/3446 418/8 |
| 4,088,426 | A * | 5/1978 | Edwards | F04C 29/12 418/8 |
| 4,541,791 | A * | 9/1985 | Ideta | F16H 61/0025 418/257 |
| 2002/0114708 | A1* | 8/2002 | Hunter | F04C 14/226 417/220 |
| 2007/0224066 | A1* | 9/2007 | Yamamuro | F04C 14/226 418/136 |
| 2009/0180913 | A1* | 7/2009 | Kimberlin | F04C 2/3446 418/261 |
| 2014/0234150 | A1* | 8/2014 | Sugihara | F04C 2/3446 418/260 |
| 2019/0338771 | A1* | 11/2019 | Bennett, Sr. | F04C 14/22 |
| 2020/0032791 | A1* | 1/2020 | Bennett, Sr. | F16F 1/12 |

FOREIGN PATENT DOCUMENTS

| | | | | | |
|---|---|---|---|---|---|
| DE | 10 2012 018 965 | A1 | | 9/2013 | |
| DE | 10 2014 219 354 | A1 | | 3/2016 | |
| JP | 6-18681 | U | | 3/1994 | |
| JP | 6-83977 | U | | 12/1994 | |
| JP | 2005120893 | A | * | 5/2005 | |
| JP | 2006283592 | A | * | 10/2006 | F04C 18/322 |
| WO | WO-9203636 | A1 | * | 3/1992 | |
| WO | WO-9906710 | A1 | * | 2/1999 | F01C 21/0863 |
| WO | WO 2008/148472 | A1 | | 12/2008 | |
| WO | WO-2012011206 | A1 | * | 1/2012 | F04C 18/0215 |
| WO | WO-2016193043 | A1 | * | 12/2016 | F01C 21/0836 |

OTHER PUBLICATIONS

DE 102012018965 English Language Machine Translation (Year: 2013).*

JP-2006283592, English language machine translation (Year: 2006).*

German Search Report Issued Feb. 2, 2023 in German Application 10 2022 111 278.0 filed on May 6, 2022 (with English Translation of Categories of Cited Documents & Written Opinion), 7 pages.

Extended European Search Report issued Oct. 5, 2023, in corresponding European Patent Application No. 23168836.7, 7 pages.

* cited by examiner

ROTARY VANE PUMP

BACKGROUND OF THE INVENTION

Field of the Invention

The invention relates to a rotary vane pump, in particular for hydraulic fluid.

Description of the Related Art

Rotary vane pumps, also known as vane pumps, are generally known. They have a stator, a rotor arranged inside the stator, and a plurality of vanes which are displaceably accommodated in the rotor. A pump chamber is defined between each two adjacent vanes in the circumferential direction.

One application of a rotary vane pump is constituted by hydraulic units in which the rotor is driven by an electric motor. The rotary vane pump then provides a volume flow of hydraulic fluid which can be used, for example, to supply a clutch actuator or a gear actuator.

BRIEF SUMMARY OF THE INVENTION

The object of the invention is to create a rotary vane pump that is characterized by a particularly high delivery rate.

To solve this problem, a rotary vane pump is provided in accordance with the invention, having a pump housing, a stator, a rotor, a plurality of vanes which are accommodated in the rotor so as to be displaceable in the radial direction, so that they delimit a plurality of pump chambers between themselves, the stator and the rotor, wherein a radially inner cam surface is provided, against which the vanes rest, wherein secondary chambers are delimited in the radial direction between the cam surface and the rotor and in the circumferential direction between the vanes, with a suction inlet and a pressure outlet being assigned to the secondary chambers. The cam surface ensures a "positive guidance" of the vanes so that they reliably rest against the stator and provide a seal there, even at particularly low speeds. The rotary vane pump according to the invention can therefore be operated at very low speeds, at which the centrifugal forces acting on the vanes are not sufficient for the vanes to reliably rest against the stator and provide a seal there. At such low speeds, the cam surface ensures that the vanes are in contact with the stator. Furthermore, with the secondary chambers, to which a suction inlet and a pressure outlet are assigned, a region of the rotary vane pump is used to generate the volume flow that is usually ignored with regard to the flow rate, namely the volume between the cam surface and the rotor. In this region, too, the design results in chambers that can be used to convey the hydraulic fluid if a suction inlet and a pressure outlet are provided at suitable positions. This results in a very high overall efficiency.

The cam surface is preferably located axially inside the rotor, resulting in a compact design in the axial direction. Furthermore, additional axial space is available in the region of the cam surface, in which space a bearing can be arranged for supporting the rotor in the pump housing.

The cam surface preferably has a width in the axial direction of between 5% and 15% of the axial length of the rotor. This value has proved to be a good compromise between, on the one hand, a not excessively high surface pressure between the vans and the cam surface and, on the other hand, the greatest possible axial length of the rotor.

The cam surface can be formed in one piece with an end wall of the pump housing so that no separate assembly is required.

Connection channels for pump chambers can be formed radially within the cam surface, resulting in a compact design overall.

According to one embodiment of the invention, the volume inside the rotor delimited by the slots for receiving the vanes, the end walls of the pump housing and the end face of the vanes is connected to a suction inlet and a pressure outlet. This volume, in addition to the main delivery chambers and the secondary chambers, represents a third type of chamber used to deliver hydraulic fluid. Within these chambers, the vanes operate in the manner of pump pistons, drawing hydraulic fluid in and displacing it out of the chambers when the vanes are pushed out of or into the slot as the rotor rotates in the radial direction.

According to one embodiment of the invention, the vanes are designed in a stepped manner on the radially inner side, with a guide surface which cooperates with the cam surface, and a radially further inner end face which is accommodated within the rotor. The radial offset between the guide surface and the inner end face of the vanes results in a seal in the region of the cam surface, so that a hydraulic short circuit is avoided in this region.

The end face can protrude beyond the guide surfaces by a length in the order of 5 to 15% of the height of the vane. This value is sufficient to ensure that the desired seal is achieved in this region.

BRIEF DESCRIPTION OF THE SEVERAL VIEWS OF THE DRAWINGS

The invention will be described below on the basis of an embodiment which is illustrated in the appended drawings. In the drawings.

DETAILED DESCRIPTION OF THE INVENTION

Figure 1:
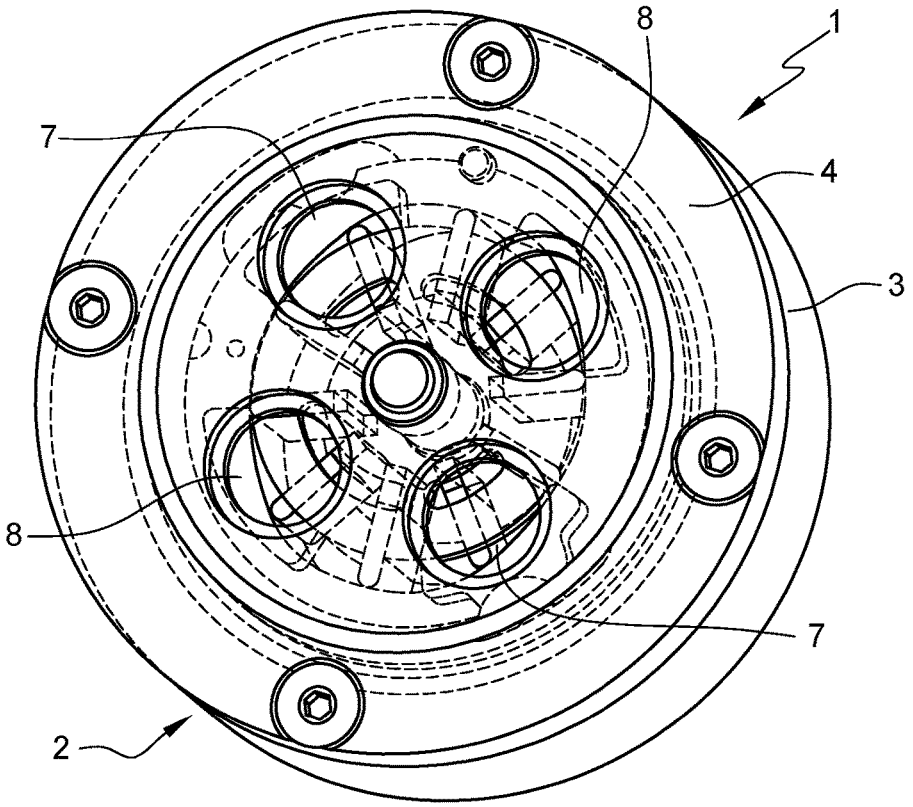
FIG. 1 shows a perspective view of the rotary vane pump, wherein part of the housing is shown transparent so that the inner workings of the pump are visible.
Figure 2:
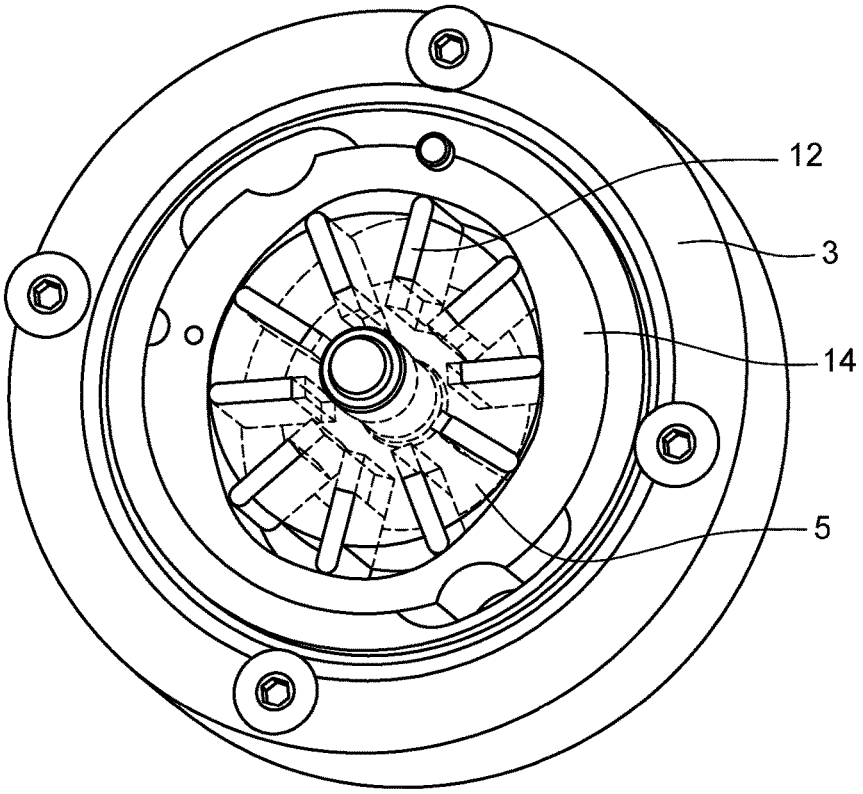
FIG. 2 shows the rotary vane pump in FIG. 1, wherein a housing cover is removed.

FIGS. 1 to 9 schematically show a rotary vane pump 1 that can be used in particular to provide a volume flow of hydraulic fluid in a hydraulic unit.

The rotary vane pump 1 has a pump housing 2, which is formed from a main body 3 and a housing cover 4. A rotor 5 is arranged inside the housing and is mounted on a shaft 6 for conjoint rotation. This can be driven by an electric motor, not shown.

The rotary vane pump is a two-stroke pump, so that the housing cover 4 has two intake openings 7 and two delivery openings 8.

The rotor 5 has a plurality of slots 10, each of which receives a vane 12.

The vanes interact with their radially outer end with the inner face of a stator 14, which is accommodated in the pump housing 2.

The rotary vane pump 1 has a cam surface 16 against which the vanes 12 rest with their radially inner side.

The cam surface 16 is formed here as a projection on the end face of the main body 3 facing the rotor 5, wherein the rotor 5 is designed to be axially shorter in this region. In its radially outer region, the rotor 5 is designed with its full width (see FIG. 4), so that the rotor 5 and the cam surface 16 overlap each other (in the region of the right plane of section in FIG. 4).

Figure 3:
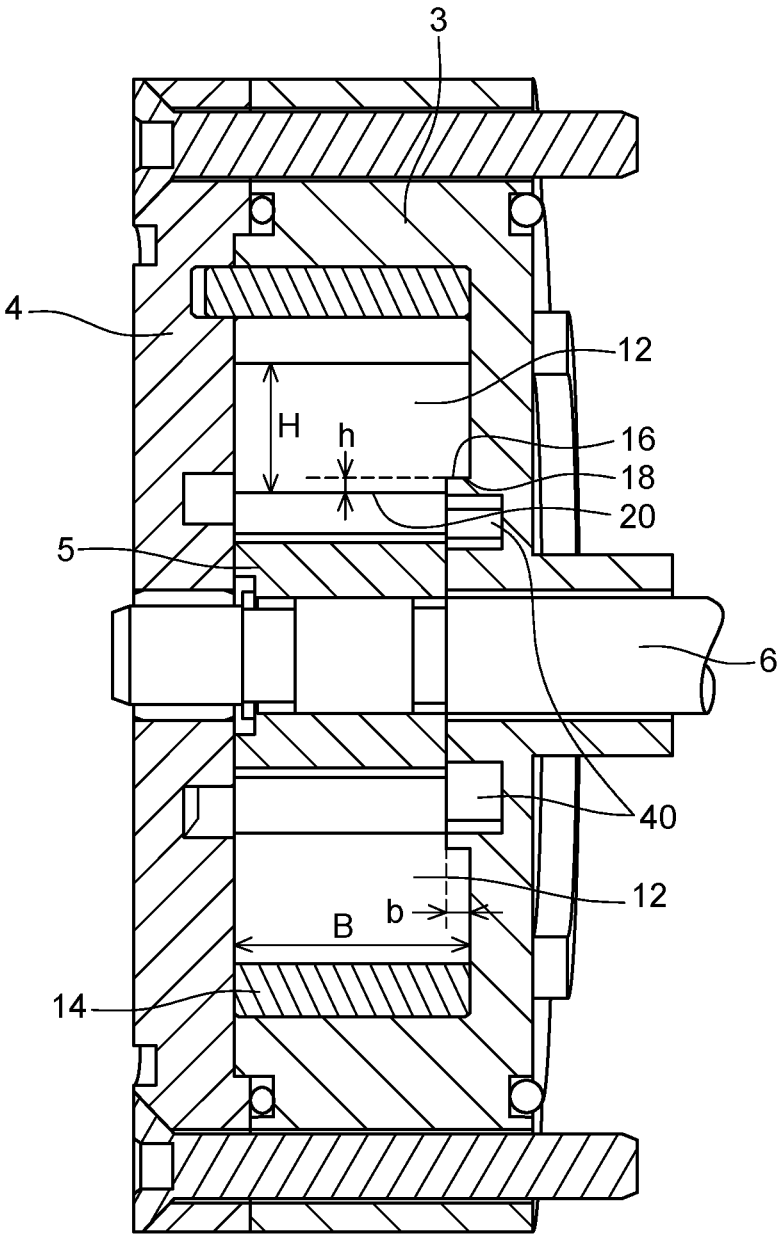
FIG. 3 shows a first cross-section through the rotary vane pump.
Figure 4:
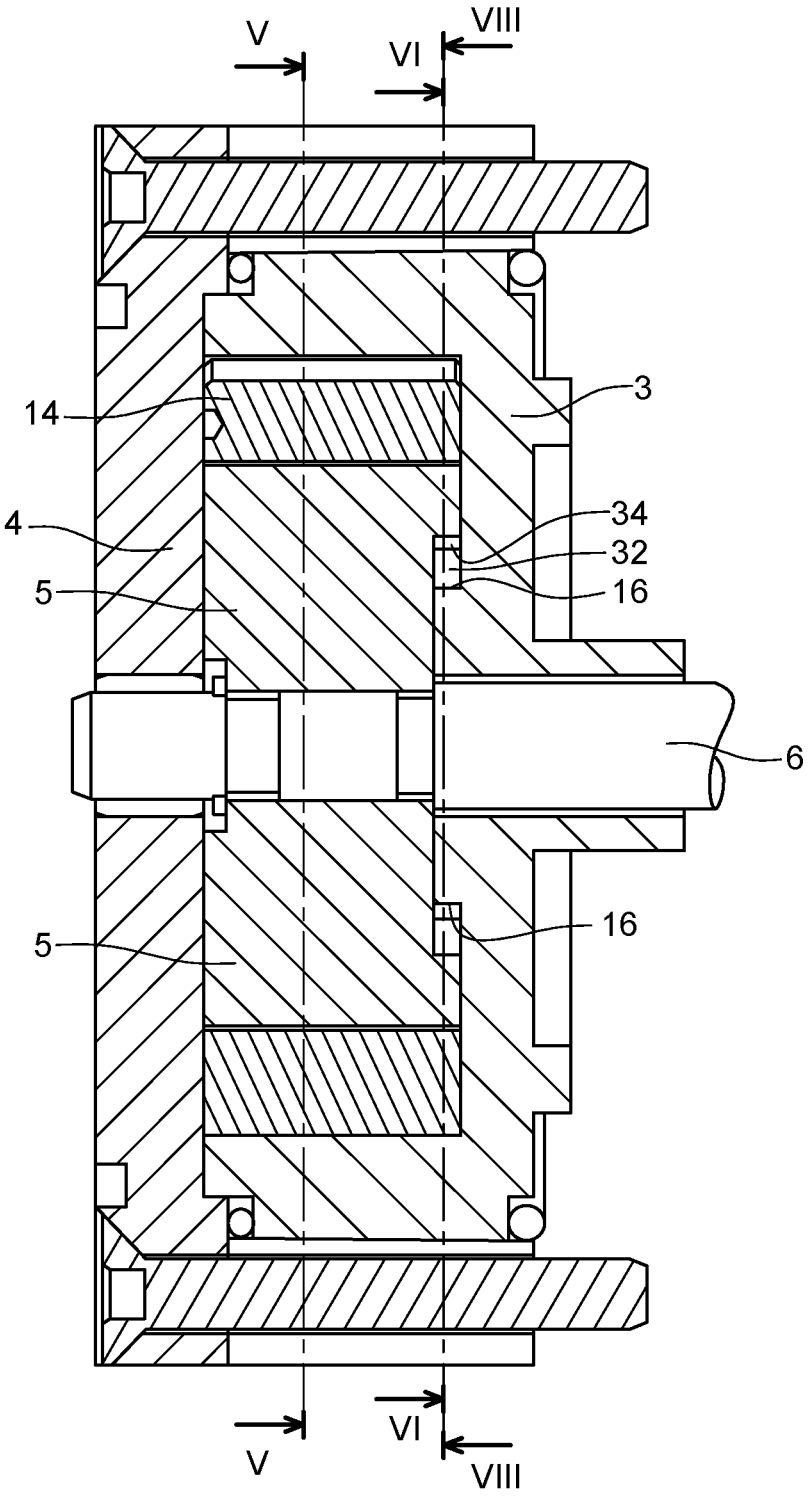
FIG. 4 shows a second cross-section through the rotary vane pump.
Figure 5:
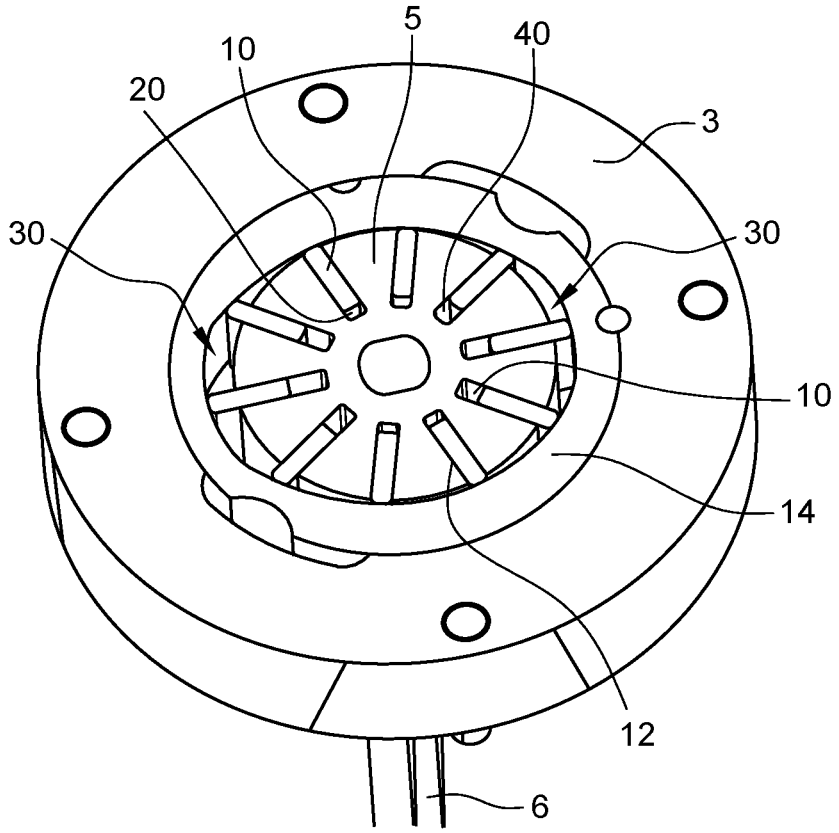
FIG. 5 shows a perspective view of a section along the plane V-V in FIG. 4.
Figure 6:
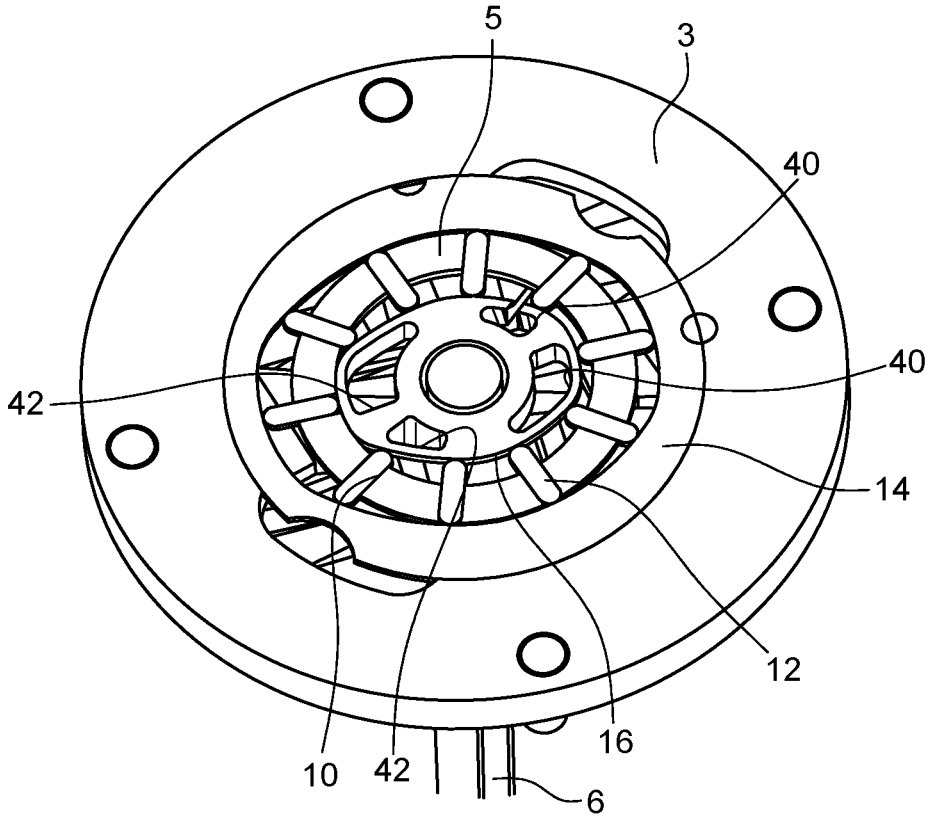
FIG. 6 shows a perspective view of a section along the plane VI-VI in FIG. 4.

Specifically, the vanes 12 have a guide surface 18 (see in particular FIG. 9), which is stepped in relation to the radially inner end face 20 of the vanes 12 (see in particular FIG. 3).

The height of step h (see FIG. 3) is in the order of 5 to 15% of the total height H of the vanes 12.

The width b of the guide surface 18 (see also FIG. 3) is in the order of 10 to 15% of the total width B of the vanes 12.

The cam surface 16, together with the guide surface 18, provides a positive guide for the vanes 12, which ensures that the vanes 12 move outwards when the rotor 5 rotates, even if the centrifugal forces acting are relatively small.

Figure 8:
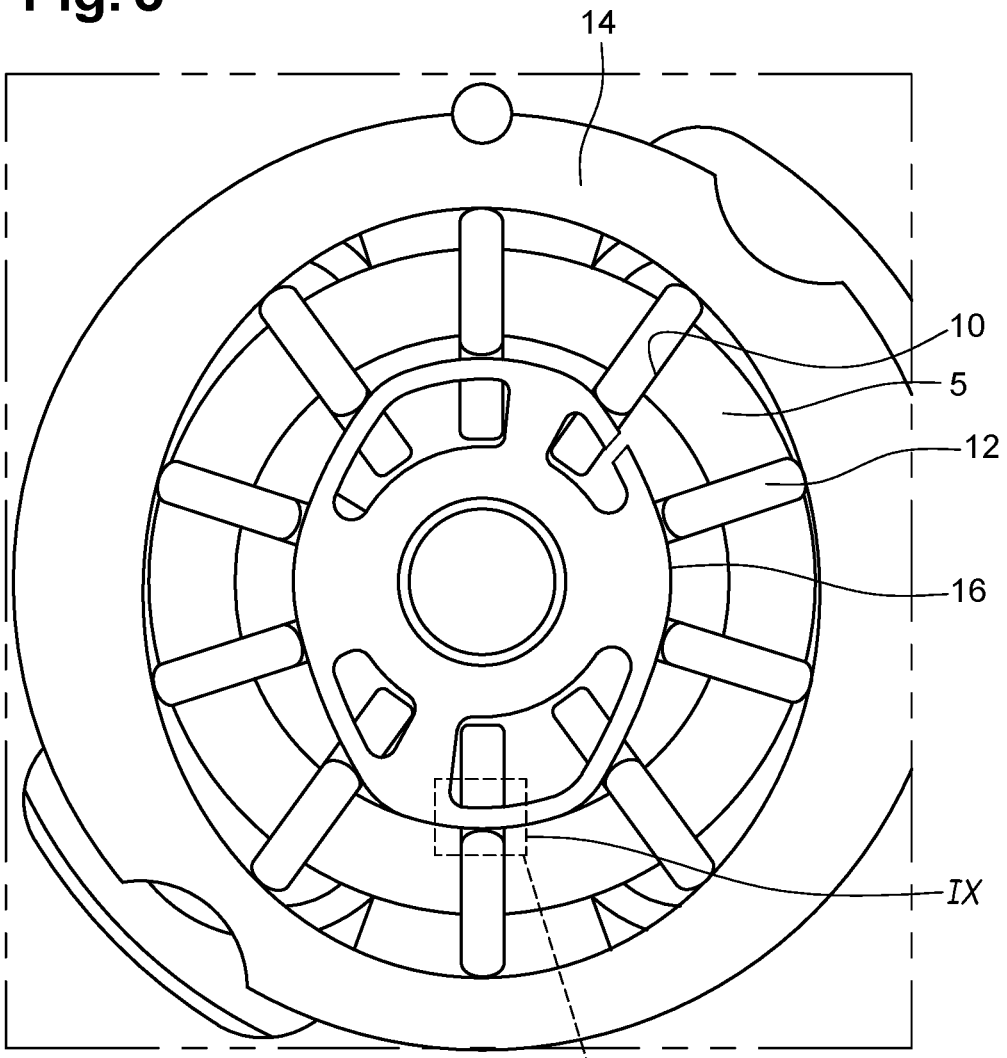
FIG. 8 shows a section along the plane VII-VII in FIG. 4.
Figure 9:
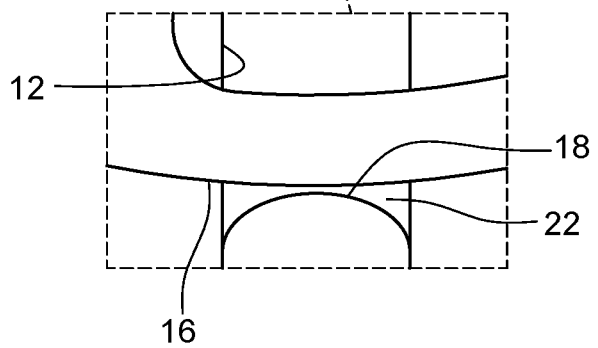
FIG. 9 shows the detail IX in FIG. 8 on an enlarged scale.

As can be seen in particular in FIG. 8, the course of the cam surface 16 corresponds to an envelope contour formed from the guide surfaces 18 of the vanes 12, which is created when the rotor 5 rotates and the vanes 12 simultaneously make contact with the stator 14. It is advantageous, for example, to design the vanes 12 in this region to be of constant thickness; the radii of the outer and inner guide surfaces may indeed be different, but should have a common central axis. Deviations from this are possible, since a functionally suitable envelope contour can, nevertheless, be constructed.

As can be seen in particular in FIG. 8, the course of the cam surface 16 corresponds to the course of the inner contour of the stator 14. In other words, the distance between the cam surface 16 and the inner face of the stator 14 measured in the radial direction is constant along the circumference of the cam surface.

Due to the offset between the guide surface 18 and the further inner end face 20 of the vane, a shoulder 22 is formed which acts as a seal. The shoulder 22 prevents hydraulic fluid from entering the corresponding slot 10 in the rotor 5 from the delivery chambers between the vanes 12.

A special feature of the rotary vane pump 1 is that a total of three different types of delivery chambers are used to provide the volume flow.

The majority of the volume flow is provided by the main chambers, which are delimited in the circumferential direction between adjacent vanes 12 and in the radial direction between the rotor 5 and the stator 14. In the axial direction, the main chambers, which are marked here with the reference sign 30, are delimited between the opposing end faces of the main body 3 and the housing cover 4 of the pump housing 2.

Another type of delivery chamber is constituted by secondary chambers 32, which are delimited between the cam surface 16 and the inner face 34 of the rotor 5 opposite the cam surface 16. These secondary chambers have a radial height of almost zero in the region I in FIG. 7, while their radial height is maximal in the region II in FIG. 7.

Figure 7:
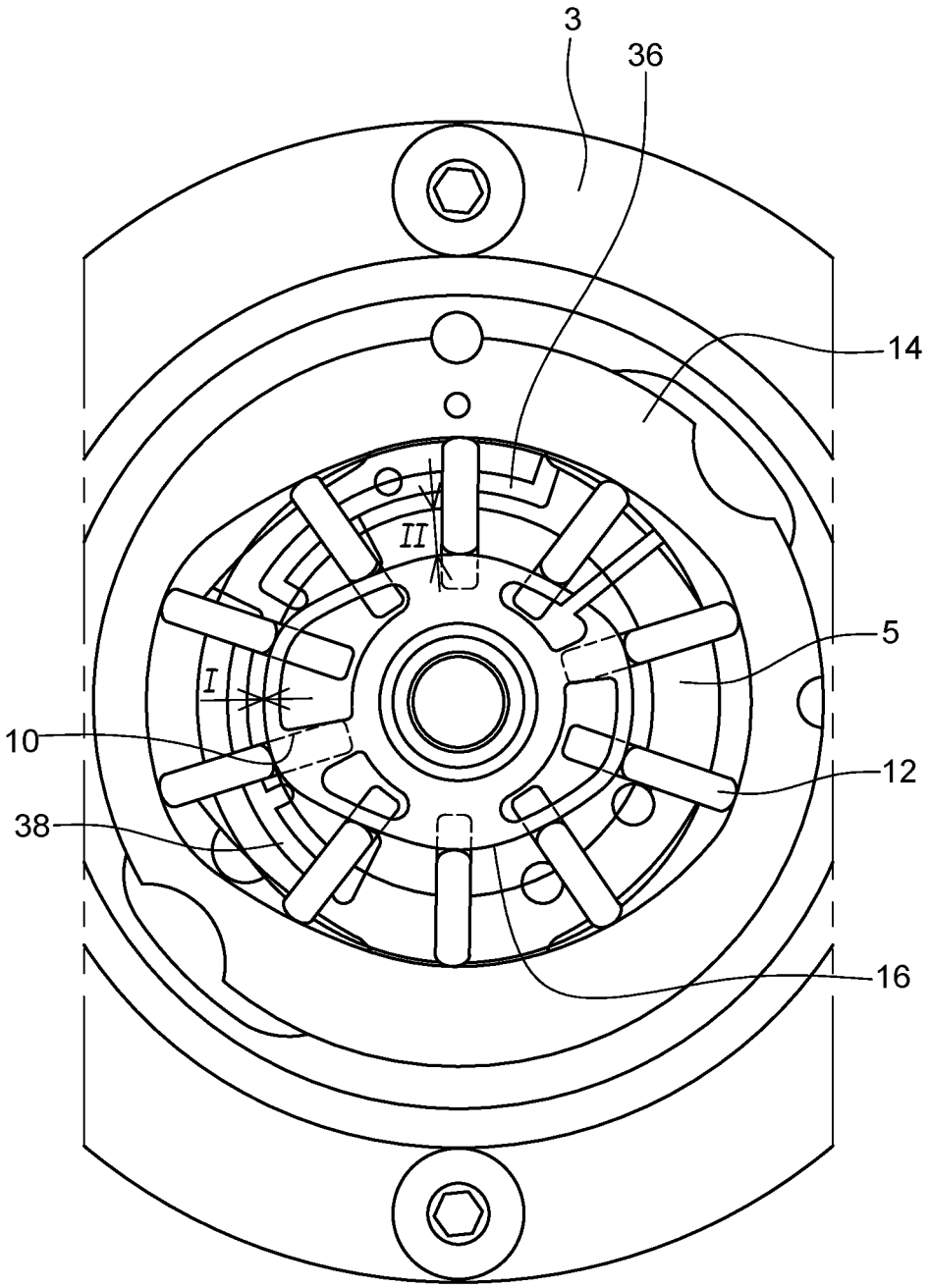
FIG. 7 shows the section along the plane VI-VI, wherein parts of the pump housing are shown transparent to make fluid channels visible.

FIG. 7 also shows a suction inlet 36 associated with the secondary chambers 32 and a pressure outlet 38. FIG. 7 shows a pump with two different displacements per pump stream. The stream with smaller displacement has a simplified intake port in the form of the two holes leading to the rotor chamber of the electric motor; this flow is used to cool the electric motor. The pressure port of the secondary chambers 32 of the smaller stream leads into the suction region of the main chambers via a groove. If the pump strokes are of the same size, it is advantageous to design the intake and pressure outlets 36 and 37 for both streams.

Lastly, there is a third type of delivery chamber, hereinafter referred to as auxiliary chambers 40. These are formed within the slots 10 in the rotor 5 between the walls of the rotor and the end faces 20 of the vanes 12. Here, the vanes 12 act similarly to the pistons of a piston pump in that, during each revolution, they are pushed into the corresponding slot 10 twice (corresponding to an ejection movement of the hydraulic fluid) and are forced axially outwards twice (corresponding to the intake phase).

The associated intake and pressure ports are denoted here by the reference sign 42.

Due to the three different types of delivery chambers, the rotary vane pump 1 has a particularly large displacement per revolution and thus a high delivery capacity with a small overall volume.

The invention claimed is:

1. A rotary vane pump comprising:

a pump housing with a main body and a cover, a stator, a rotor, a plurality of vanes which are accommodated in the rotor so as to be displaceable in a radial direction, so that the plurality of vanes delimit a plurality of pump chambers between the plurality of vanes, the stator and the rotor, wherein a radially inner cam surface is provided, against which the plurality of vanes rest, wherein the cam surface is located axially inside the rotor, wherein the cam surface is formed in one piece with the main body, wherein secondary chambers are delimited in the radial direction between the cam surface and the rotor and in a circumferential direction between the plurality of vanes, with a suction inlet and a pressure outlet being assigned to the secondary chambers, and wherein the plurality of vanes are designed in a stepped manner on a radially inner side, with a guide surface which cooperates with the cam surface, and a radially further inner end face which is accommodated within the rotor.

2. The rotary vane pump according to claim 1, wherein connection channels for the pump chambers are formed radially within the cam surface.

3. The rotary vane pump according to claim 1, wherein a volume inside the rotor delimited by slots for receiving the plurality of vanes, end walls of the pump housing, and end faces of the plurality of vanes is connected to the suction inlet and the pressure outlet.

4. The rotary vane pump according to claim 1, wherein connection channels for the pump chambers are formed radially within the cam surface.

5. The rotary vane pump according to claim 1, wherein a volume inside the rotor delimited by slots for receiving the plurality of vanes, end walls of the pump housing, and end faces of the plurality of vanes is connected to the suction inlet and the pressure outlet.

6. The rotary vane pump according to claim 1, wherein the radially further inner end face protrudes beyond the guide surface by a length in the order of 5% to 15% of a height of one vane of the plurality of vanes.

7. A rotary vane pump comprising:

a pump housing with a main body and a cover, a stator, a rotor, a plurality of vanes which are accommodated in the rotor so as to be displaceable in a radial direction, so that the plurality of vanes delimit a plurality of pump chambers between the plurality of vanes, the stator and the rotor, wherein a radially inner cam surface is provided, against which the plurality of vanes rest, wherein the cam surface is located axially inside the rotor, wherein the cam surface is formed in one piece with the main body, wherein secondary chambers are delimited in the radial direction between the cam surface and the rotor and in a circumferential direction between the plurality of vanes, with a suction inlet and a pressure outlet being assigned to the secondary chambers, wherein the cam surface has a width in an axial direction of between 5% and 15% of an axial length of the rotor, and wherein the plurality of vanes are designed in a stepped manner on a radially inner side, with a guide surface which cooperates with the cam surface, and a radially further inner end face which is accommodated within the rotor.

* * * * *